US008502476B2

(12) United States Patent
Keh

(10) Patent No.: US 8,502,476 B2
(45) Date of Patent: Aug. 6, 2013

(54) METHOD AND APPARATUS FOR CONTROLLING POWER CONSUMPTION OF LIGHT SOURCE IN MOBILE PROJECTOR

(75) Inventor: Young-Chan Keh, Seoul (KR)

(73) Assignee: Samsung Electronics Co., Ltd (KR)

( * ) Notice: Subject to any disclaimer, the term of this patent is extended or adjusted under 35 U.S.C. 154(b) by 323 days.

(21) Appl. No.: 12/904,482

(22) Filed: Oct. 14, 2010

(65) Prior Publication Data

US 2011/0089845 A1 Apr. 21, 2011

(30) Foreign Application Priority Data

Oct. 16, 2009 (KR) ..... 10-2009-0098958
Jun. 30, 2010 (KR) ..... 10-2010-0063128

(51) Int. Cl.
*H05B 37/02* (2006.01)

(52) U.S. Cl.
USPC ..... 315/308; 315/209 R; 315/360

(58) Field of Classification Search
USPC ..... 291/291, 294, 297, 299, 307, 308, 291/312; 315/209 R, 247, 291, 294, 297, 315/299, 307, 308, 312, 360
See application file for complete search history.

(56) References Cited

U.S. PATENT DOCUMENTS 6,153,985 A * 11/2000 Grossman ..... 315/291
7,511,436 B2 * 3/2009 Xu ..... 315/307
2003/0117088 A1 * 6/2003 Tanabe et al. ..... 315/291
2005/0104542 A1 5/2005 Ito et al.
2006/0290625 A1 12/2006 Sugimoto
2007/0200513 A1 8/2007 Ha et al.
2007/0280314 A1 12/2007 Keh et al.
2008/0055566 A1 3/2008 Yun
2010/0060204 A1 * 3/2010 Ohtake et al. ..... 315/307
2010/0128052 A1 5/2010 Keh
2010/0259191 A1 * 10/2010 Ghanem et al. ..... 315/297

FOREIGN PATENT DOCUMENTS

KR 1020100058842 6/2010
WO WO 2009/122488 10/2009

OTHER PUBLICATIONS

Wang et al.: "A Novel Automatic Power Control System for a Light Emitting Diode Driving System", 4th IEEE Conference on Industrial Electronics and Applications, May 25, 2009.

* cited by examiner

*Primary Examiner* — Tung X Le
(74) *Attorney, Agent, or Firm* — The Farrell Law Firm, P.C.

(57) ABSTRACT

A method of controlling the power consumption of a light source in a mobile projector, including calculating power consumption of the light source, and comparing the calculated power consumption with a preset power value, and automatically adjusting current flowing to the light source according to a resultant value of the comparison. Calculating power consumption of the light source includes measuring a voltage applied to both terminals of the light source, measuring current flowing to the light source, and calculating power consumption of the light source by multiplication of the measured voltage and current. Adjusting the current flowing to the light source includes calculating a difference between the preset power value and the calculated power consumption of the light source, adding/subtracting the calculated difference value to/from a preset current value to output a resultant value, and changing the voltage output to the light source according to the resultant output value.

21 Claims, 8 Drawing Sheets

METHOD AND APPARATUS FOR CONTROLLING POWER CONSUMPTION OF LIGHT SOURCE IN MOBILE PROJECTOR

PRIORITY

This application claims priority under 35 U.S.C. §119(a) to applications filed in the Korean Industrial Property Office on Oct. 16, 2009 and Jun. 30, 2010, assigned Serial Nos. 10-2009-0098958 and 10-2010-0063128, respectively, the contents of which are incorporated herein by reference.

BACKGROUND OF THE INVENTION

1. Field of the Invention

The present invention relates generally to a mobile projector mounted on a mobile communication terminal, and more particularly to a method of controlling the power consumption of a light source such as Light Emitting Diodes (LEDs) used in the mobile projector.

2. Description of the Related Art

Recently, in order to overcome limited display size, a mobile communication terminal has been developed to have a TV-OUT function and a function to display information of the mobile communication terminal on an external large-scale display device by connection to an external projector. Also, a mobile projector technique that mounts a subminiature projector module on the mobile communication terminal instead of the external projector has been developed.

In general, a mobile projector uses LEDs as a light source. Also, in order to control the power of the LEDs, a circuit as illustrated in FIG. 1 is used in conventional systems.

Referring to FIG. 1, if light is emitted from the LED as current flows to the LED (not shown), an mPD (monitor Photo Diode) senses the output light and generates a corresponding photocurrent. As the photocurrent flows to a feedback resistor R, a voltage is generated across the feedback resistor R. This voltage is input to a feedback (FB) terminal of an Automatic Power Control (APC) LED driver 110, and is compared with a reference voltage, so that an LED driving current is increased or decreased to uniformly control the intensity of power output from the LED. This is generally called an APC drive.

However, when using the above-described conventional LED power control system for a mobile projector, several problems may occur, as described with reference to FIGS. 2A and 2B.

Referring to FIGS. 2A and 2B, the LED has characteristics that, if an operation environment temperature increases, the LED light power is reduced. Particularly, for a red LED among Red, Green, and Blue (RGB) light sources used for the mobile projector, the light power is abruptly decreased as operation temperature increases, resulting in a reduction of the light power of about −8% per 10° C. Accordingly, if the red LED is driven by the APC, it is necessary to increase the driving current to compensate for the light power that is reduced due to temperature increase. FIG. 2A shows the LED power consumption according to the operation environment temperature of the LED. Increased driving current for the above-described reasons causes additional heat generation of the LED, and when a conventional power control circuit is applied to the mobile projector, which rarely has a sufficient heat sink to dissipate the additional heat, the increase of the driving current brings an unacceptable increase in heat generation, with an associated temperature increase. As a result, a vicious cycle exists of increasing the driving current to compensate for reduced light power caused by temperature increase (i.e. increased driving current→increased heat generation→temperature increase→increased driving current), and thus the system may fail due to thermal runaway.

Also, if operation time is lengthened, the light power of the LED is reduced due to a gradual degradation, causing increased driving current by the APC operation. FIG. 2B shows the LED power consumption over time. In this case, the driving current is increased to compensate for the light power that is reduced over time, as described above. The increase of the driving current causes increased heat generation, the increased heat generation causes the temperature to increase, and as a result, a vicious cycle of increasing the driving current to compensate for the light power that is reduced due to the temperature increase is repeated. Accordingly, the probability that a sudden failure of the LED occurs is heightened.

To mitigate the above-described problems, a limit value of the driving current may be set. However, in an RGB time-sequential type projector, if the driving current of any one color reaches the limit value, the light power of that color become relatively insufficient to cause a problem of white point distortion. For example, when a limit value for the R (Red) color current is reached, the light power for the R color will not be further increased, and thus a blue shift problem that the white point is shifted to the Blue (B) color may occur during the additional increase of the operation temperature.

SUMMARY OF THE INVENTION

Accordingly, the present invention has been made to solve the above-mentioned problems occurring in conventional systems, and the present invention provides a method and an apparatus for uniformly maintaining LED electric power consumption rather than uniformly maintaining the optical output of the LED in a mobile projector. Accordingly, for an RGB time-sequential type mobile projector, the present invention provides a method and an apparatus for uniformly maintaining the whole power consumption of RGB LED while maintaining the RGB white point.

In accordance with an aspect of the present invention, there is provided a method of controlling electric power of a light source in a mobile projector, which includes calculating power consumption of the light source; and comparing the calculated power consumption of the light source with a preset power value and automatically adjusting current flowing to the light source according to a resultant value of the comparison, wherein the light source is at least one of an LED or an OLED, calculating the power consumption of the light source includes measuring a voltage applied to both terminals of the light source; measuring the current flowing to the light source; and calculating the power consumption of the light source by calculating multiplication of the measured voltage and current, and adjusting the current flowing to the light source includes calculating a difference between the preset power value and the calculated power consumption of the light source; adding/subtracting the calculated difference value to/from a preset current value to output a resultant value; and changing the voltage output to the light source according to the resultant output value.

In accordance with another aspect of the present invention, there is provided an apparatus for controlling electric power of a light source in a mobile projector, which includes a power calculation unit calculating electric power of the light source; and a current adjustment unit comparing the power calculated by the power calculation unit with a preset power value and automatically adjusting current flowing to the light source according to a resultant value of the comparison, wherein the light source is at least one of an LED or an OLED, the power calculation unit includes a voltage measurement unit measuring a voltage applied to both terminals of the light source; a current measurement unit measuring the current flowing to the light source; and a calculation unit calculating the power consumption of the light source by calculating multiplication of the measured voltage and current, and the current adjustment unit includes a comparator calculating a difference between the preset power value and the power consumption of the light source which is calculated by the comparator; a dimming unit adding/subtracting the difference value calculated by the comparator to/from a preset current value to output a resultant value; and a switching unit receiving an output signal of the dimming unit and changing the output voltage to the light source according to the output signal of the dimming unit.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF EMBODIMENTS OF THE INVENTION

Figure 1:
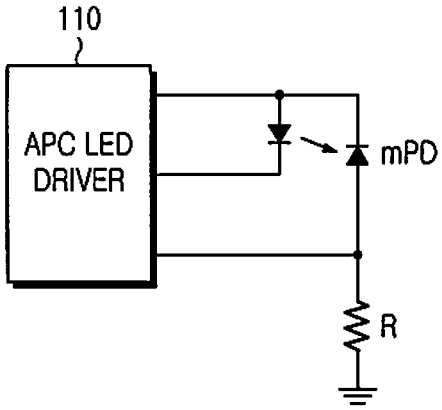
FIG.1 (PRIOR ART)
FIG. 1 illustrates a circuit for controlling an optical output of an LED in conventional systems.
Figure 2A:
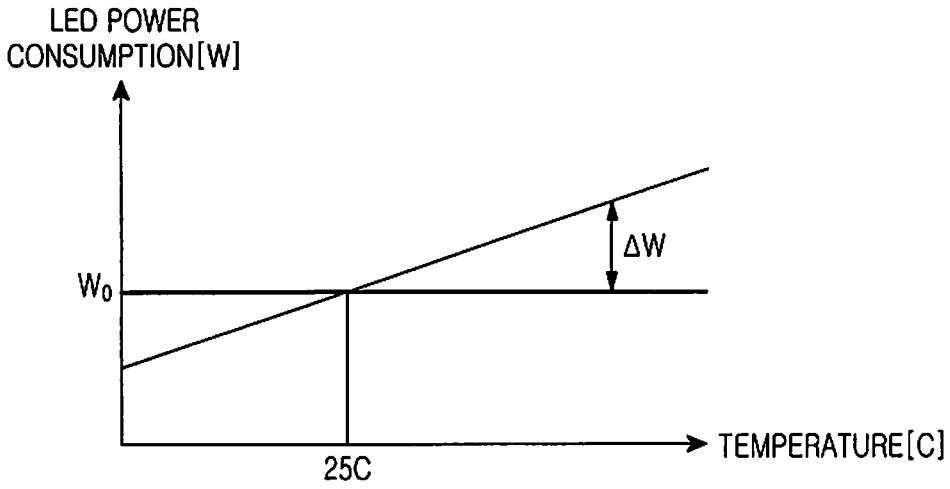
FIG.2A (PRIOR ART)
FIGS. 2A and 2B illustrate power consumption of an LED in conventional systems according to an operation temperature and operation time.
Figure 2B:
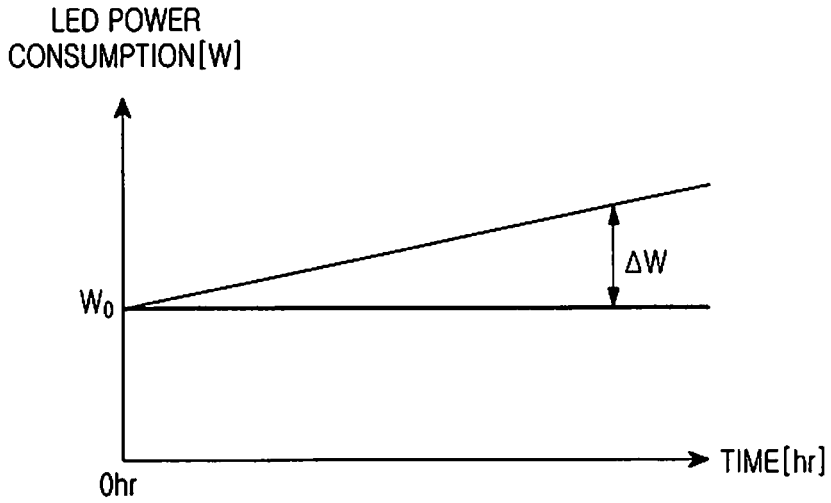
FIG.2B (PRIOR ART)

Hereinafter, embodiments are described with reference to the accompanying drawings. In the following description, the same elements will be designated by the same reference numerals although they are shown in different drawings. Further, various specific definitions found in the following description are provided only to help general understanding of the present invention, and it is apparent to those skilled in the art that the present invention can be implemented without such definitions. Further, in the following description of the present invention, a detailed description of known functions and configurations incorporated herein will be omitted when it may make the subject matter of the present invention rather unclear.

In the present invention, a light source includes a Light Emitting Diode (LED) and an Organic Light Emitting Diode (OLED).

In order to solve the problems involved in conventional systems, the present invention is provided with a hardware block (H/W block) that monitors the power consumption of the LED.

Figure 3:
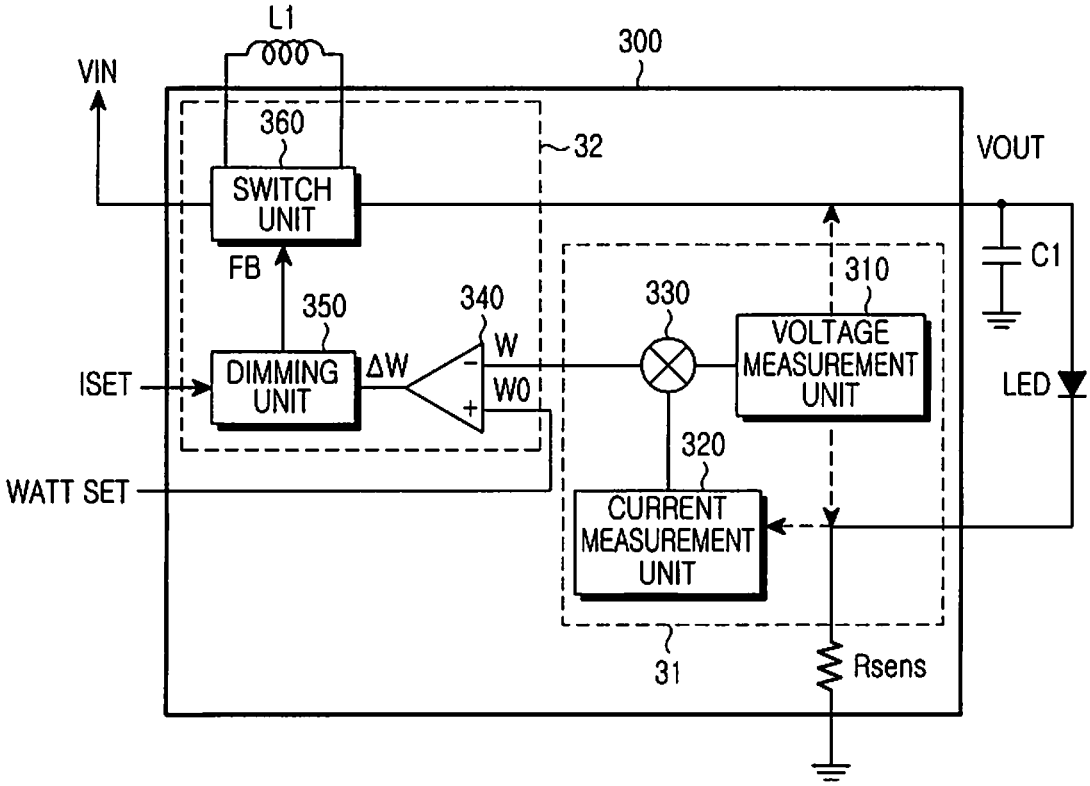
FIG. 3 illustrates a circuit for controlling the power of an LED according to a first embodiment of the present invention.

Referring to FIG. 3, a circuit 300 for controlling the power of an LED according to a first embodiment of the present invention includes a power calculation unit 31 for calculating the electric power of the LED, and a current adjustment unit 32 for adjusting current flowing to the LED by comparing the calculated power with a preset power.

The power calculation unit 31 includes a voltage measurement unit 310 for measuring a voltage applied to both terminals of the LED, a current measurement unit 320 for measuring the LED current, and a calculation unit 330 for multiplying the measured voltage and current. The current adjustment unit 32 includes a comparator 340 for calculating a difference between a preset power value (WATT SET) and the power consumption value calculated by the calculation unit 330, a dimming unit 350 for receiving an input of the difference value (ΔW) calculated by the comparator 340 and a preset current value (ISET) and adjusting dimming; and a switching unit 360 for receiving an output signal of the dimming unit 350 and changing the output voltage to the LED according to the received output signal. The LED power control circuit according to the present invention as described above is an Automatic Power Consumption Control (APCC), to avoid confusion with the APC of conventional systems.

Referring to FIG. 3, VIN denotes a power supply voltage which may be a portable phone Lithium-ion (Li+) battery power. The switching unit 360 is preferably a DC-DC converter, and may use a buck-boost converter. VOUT denotes an output voltage of the switching unit 360, which is changed according to the FB signal from dimming unit 350. If the ISET signal is input to the dimming unit 350, a constant current flows to the LED. The voltage measurement unit 310 measures the voltage applied to the LED. The current measurement unit 320 measures the LED current by monitoring voltage across resistor Rsens. The calculation unit 330 multiplies the measured voltage and current, compares the multiplied value with the preset power value (WATT SET), and calculates an increment/decrement thereof to output the calculated difference value (ΔW) to the dimming unit 350. The dimming unit 350 adds/subtracts the current increment or decrement to/from the first set ISET value, and outputs the FB signal to the switching unit 360. The switching unit 360 maintains a desired power consumption of the LED by adjusting the current flowing to the LED.

Figure 4:
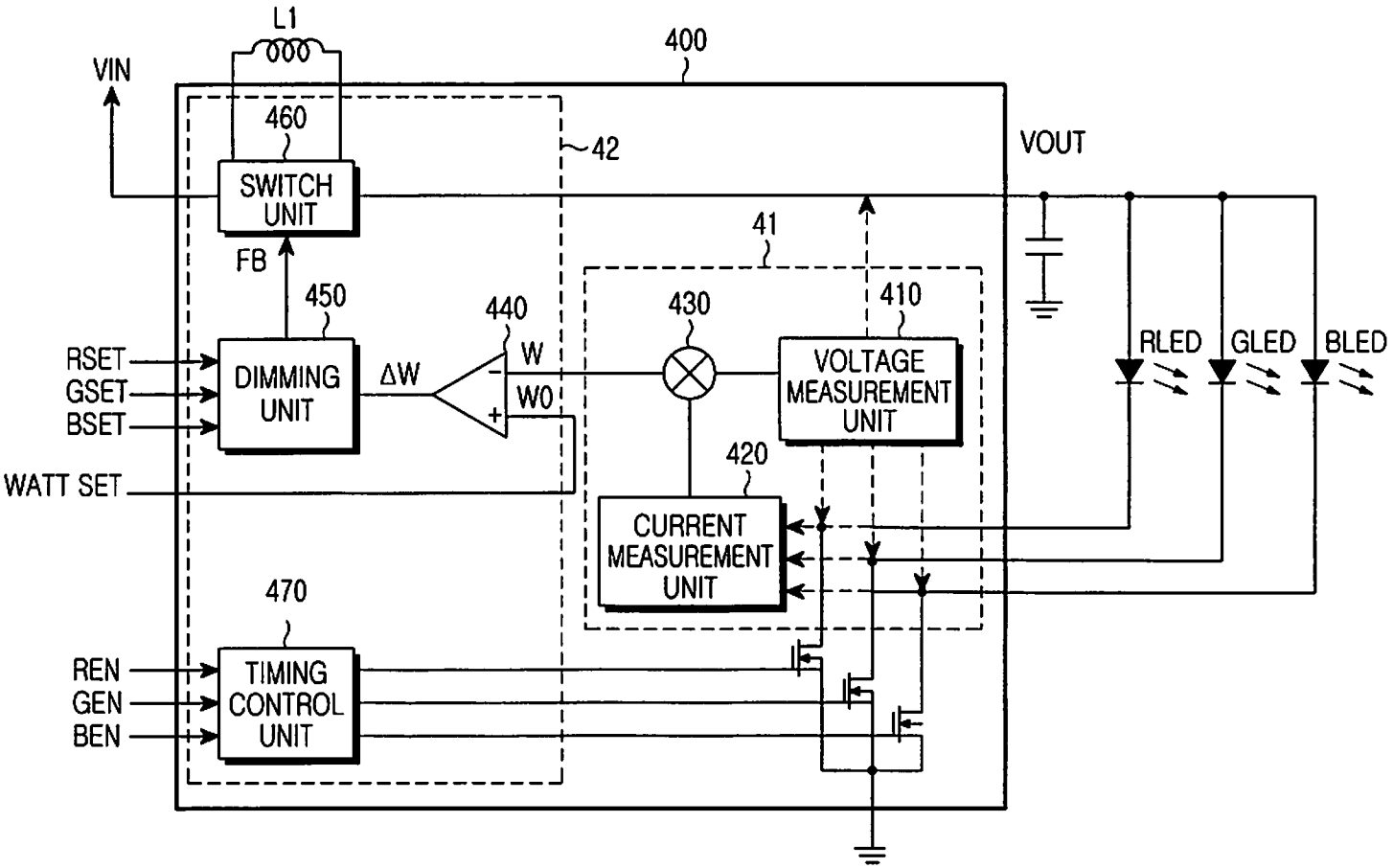
FIG. 4 illustrates a circuit for controlling the power of an LED according to a second embodiment of the present invention.

Referring to FIG. 4, which shows an APCC block that is used when a light source composed of Red, Green, and Blue (RGB) LEDs or a pair of OLEDs is time-sequentially driven, the circuit 400 for controlling the power of the LEDs according to the second embodiment of the present invention includes a power calculation unit 41 for calculating the power of the LEDs, and a current adjustment unit 42 for comparing the power calculated by the power calculation unit 41 with a preset power and adjusting the current flowing to the LEDs according to the comparison value.

The power calculation unit 41 includes a voltage measurement unit 410 for measuring a voltage applied to both ends of the RGB LEDs, a current measurement unit 420 for measuring the current of the RGB LEDs, and a calculation unit 430 for calculating a total power of the RGB LEDs by multiplying of the measured voltage and current. The current adjustment unit 42 includes a comparator 440 for calculating a difference between the preset power value (WATT SET) and the power consumption value calculated by the calculation unit 430, a dimming unit 450 for receiving the difference value calculated by the comparator 440 and preset current values RSET, GSET, and BSET and adjusting dimming, a switching unit 460 for receiving an output signal of the dimming unit 450 and changing the output voltage to the LEDs according to the received output signal to output the changed output voltage, and a timing control unit 470 for receiving external REN (RED_ENABLE), GEN (GREEN_ENABLE), and BEN (BLUE_ENABLE) signals and for time-sequential controlling transistors to control the timing of the respective LEDs.

In the second embodiment of the present invention, three RGB currents exist and the operation begins when an initial current value determined by white point calibration is set. In the same manner as in FIG. 3, the voltage measurement unit 410 and the current measurement unit 420 measure the voltage and current of the RGB LEDs, and the calculation unit 430 calculates the total power consumption of the RGB LEDs. In this case, the total power consumption may be calculated by Equation (1):

$$W = \sum_i V_i \cdot I_i \cdot D_i \tag{1}$$

In Equation (1), W denotes the total power consumption of the LEDs, i indicates R, G, or B, V denotes the voltage of the LEDs, I denotes the current of the LEDs, and D denotes a duty ratio of the RGB in the time-sequential driving.

The comparator 440 calculates an increment/decrement ΔW by comparing the calculated value W with a preset value W0 to output the ΔW to the dimming unit 450. The dimming unit 450 performs a time division of the FB signal and time-sequentially outputs the divided FB signal to the switching unit 460 to adjust the current of the RGB LEDs. The RGB LED current is changed by the switching unit 460, and the feedback operates so that the total power consumption is maintained as W0. The operation of decreasing or increasing the current in the dimming unit 450 is performed by generating the FB signal so that the initially set RGB ratio is maintained. Accordingly, even if the RGB current is changed to maintain W=W0, a change of the white point and the color temperature is suppressed.

Figure 7:
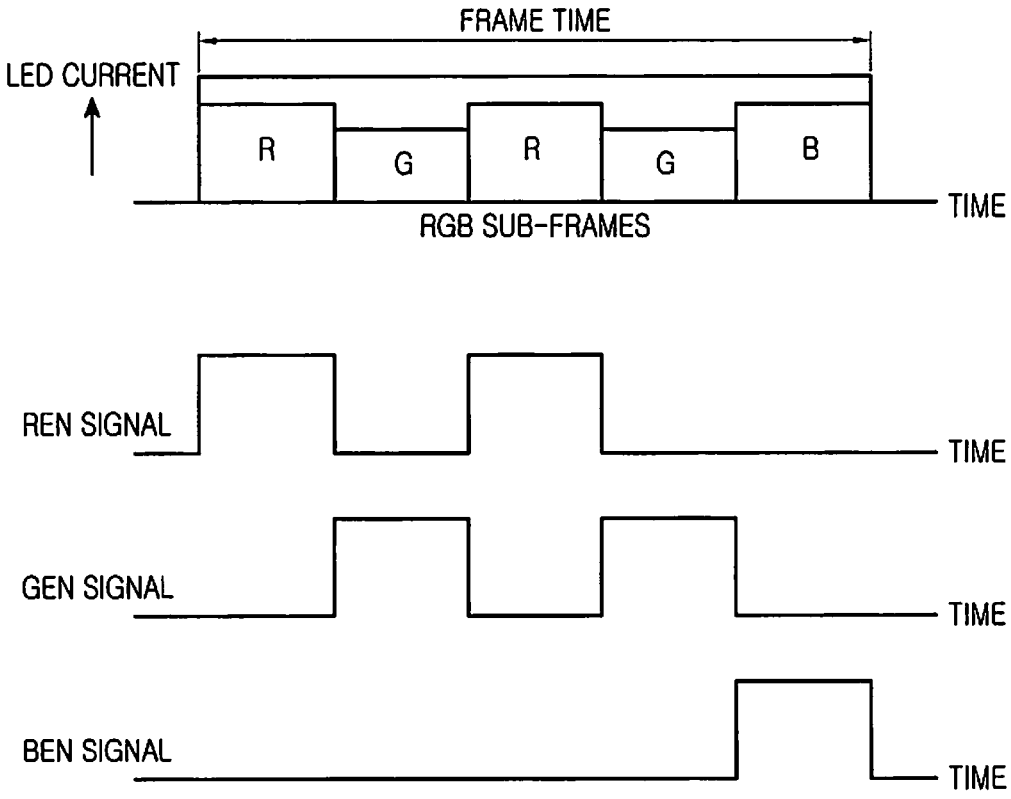
FIG. 7 illustrates examples of an enable signal of a timing control unit and an output frame in a circuit for controlling the power of an LED according to a second embodiment of the present invention.

To control the timing of the respective LEDs, the timing control unit 470 receives external REN, GEN, BEN signals and time-sequentially controls the respective transistors. The operation of the timing control unit 470 will be described with reference to FIG. 7. As illustrated in FIG. 7, the timing control unit 470 makes current flow to the corresponding LED in a time slot by controlling the corresponding transistor in accordance with the external enable signal.

Figure 5:
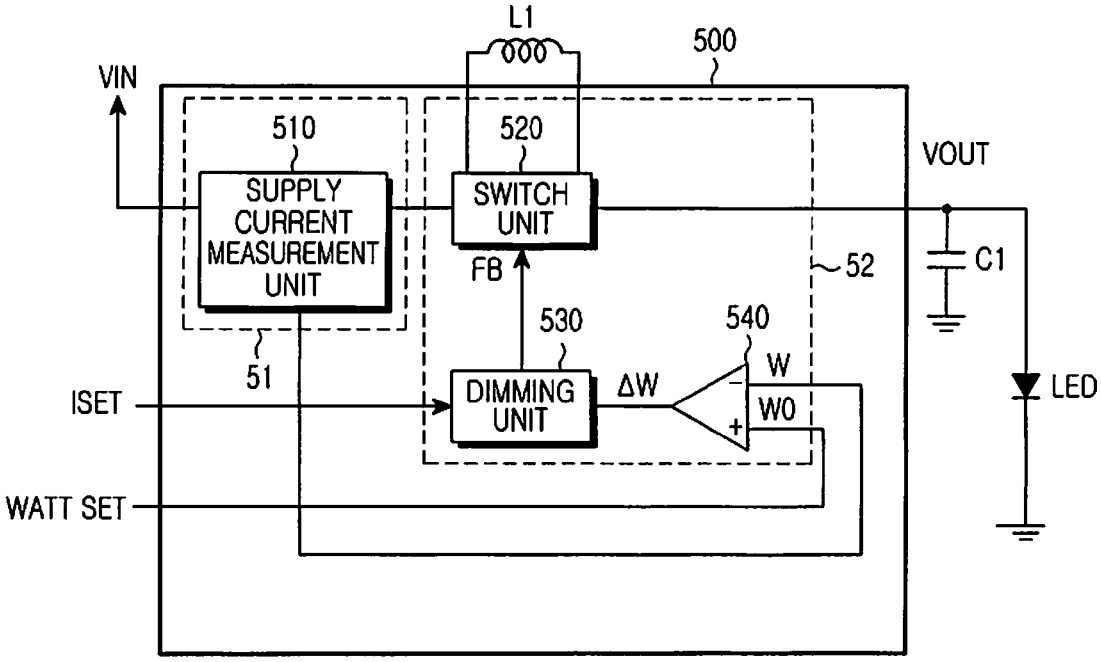
FIG. 5 illustrates a circuit for controlling the power of an LED according to a third embodiment of the present invention.

If an accuracy tolerance is to be permitted in adjusting the LED power consumption, a simplified power control circuit is configured by omitting the voltage measurement units 310 and 410 and the current measurement units 320 and 420 of FIGS. 3 and 4. Instead of the above-described voltage and current measurement units, in the third embodiment, as depicted in FIG. 5, a supply current measurement unit 510 for measuring the current supplied to the entire LED driver is used in the voltage input unit (VIN). By multiplying the supply current measurement value by VIN (typically 3.7V) and then by the power efficiency (typically 90%) of the LED driver, the LED power consumption (W) can be estimated and calculated. Since it is more practical to limit the supply current of the LED driver rather than to limit the LED power consumption when the circuit is actually applied to the mobile projector, the circuit configuration can be simplified.

Referring to FIG. 5, the circuit 500 for controlling the power of the LED according to the third embodiment of the invention briefly includes a power calculation unit 51 for calculating the power consumption of the LED, and a current adjustment unit 52 for comparing the estimated LED power with a preset power and adjusting the current flowing to the LED according to the comparison value.

Figure 6:
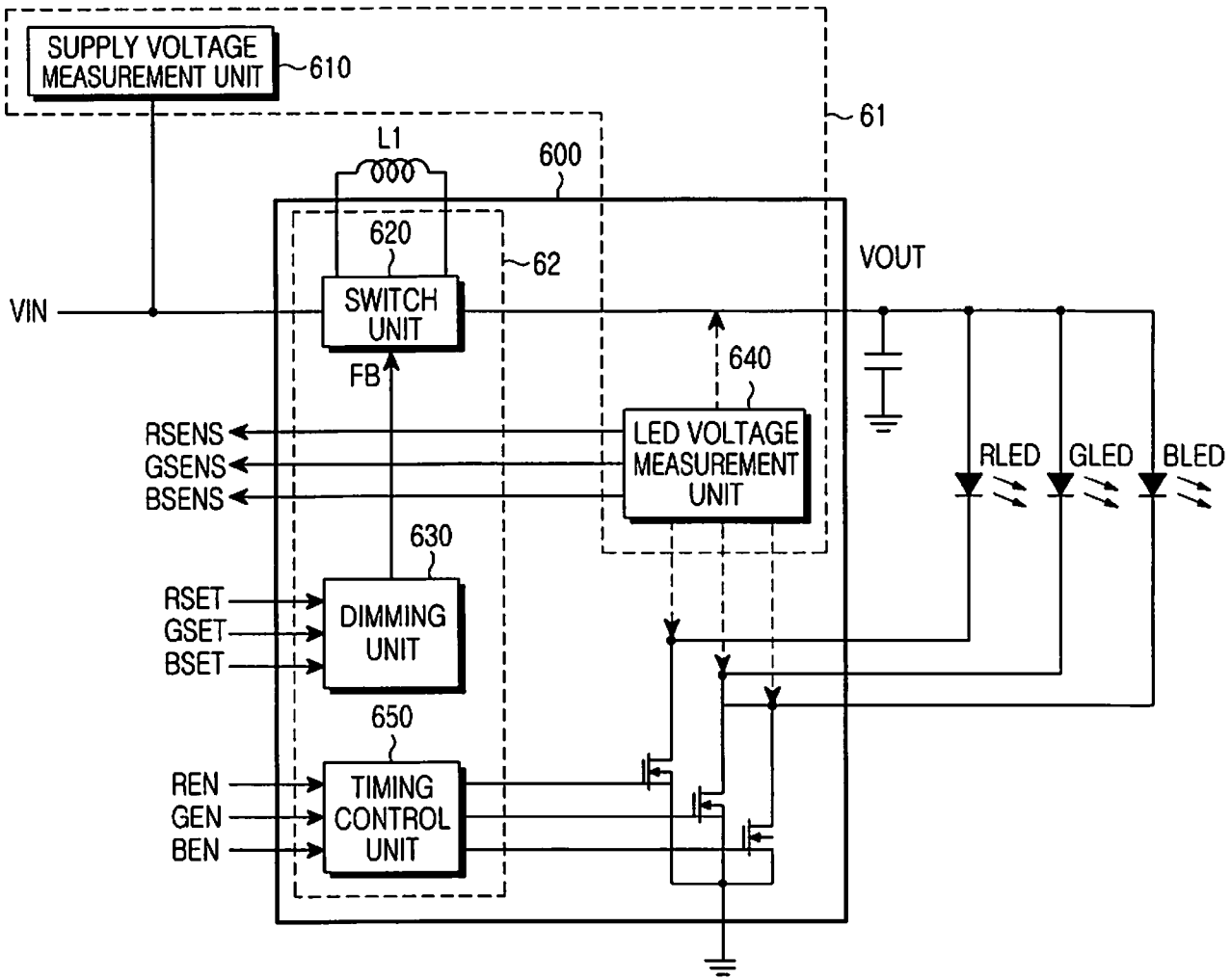
FIG. 6 illustrates a circuit for controlling the power of an LED according to a fourth embodiment of the present invention.

The power calculation unit 51 includes a supply voltage measurement unit 510 for measuring the current supplied to the LED and calculating an approximate value of the LED power consumption by multiplying the measured value by the VIN (typically 3.7V) and the power efficiency (typically 90%) of the LED driver. The current adjustment unit 52 includes a comparator 540 for calculating a difference between the preset power value (WATT SET) and the approximate value of the power calculated by the supply current measurement unit 510, a dimming unit 530 for receiving the difference value calculated by the comparator 540 and preset current value ISET, and for adjusting the dimming by outputting an FB signal, a switching unit 520 for receiving an output signal of the dimming unit 530 and changing the output voltage to the LED according to the received output signal to output the changed output voltage FIG. 6 shows a power control circuit that is used when a light source composed of red, green, and blue LEDs or a pair of OLEDs is time-sequentially driven.

In a mobile system such as a portable phone, a battery is generally used as a power supply, and load power consumption approximates the supply current. Accordingly, by uniformly maintaining the current supplied from the battery, the LED power consumption may also be uniformly maintained with little error.

However, when using the supply current measurement unit 510 as in the third embodiment of the invention as illustrated in FIG. 5, the following problems may occur. First, since a measurement element such as a resistor must be added to a current flowing path, cost and packaging space are increased. Also, since the power consumption occurs in the supply current measurement unit 510, the power efficiency is reduced. For example, if the resistance for measuring the current is 0.1 ohms and the supply current is 400 mA, the power consumption of 16 mW occurs, corresponding to the reduction of power efficiency of about 1.6%. Also, the measurement of the supply current may be inaccurate, e.g. for a general supply current of 400 mA, ±5%, an error of about ±20 mA occurs.

In the fourth embodiment of the invention, in order to improve the above-described drawbacks, a supply voltage measurement unit 610 is used instead of the supply current measurement unit 510 used in the second embodiment, and an LED voltage measurement unit 640 is used for measuring the driving voltage of the LED in the respective RGB timing.

$$W=\Sigma(V_i,I_i,D_i)/_{i=R,G,H}\sim V_{DD}\cdot I_{DD}\cdot\eta \tag{2}$$

According to the LED power consumption formula disclosed in Equation (2), $V_i$ is a driving voltage of the RGB LED, $I_i$ is a driving current of the RGB LED, $D_i$ is a duty rate of the RGB LED, $V_{DD}$ is a supply voltage, $I_{DD}$ is a supply current, and η is a power conversion efficiency of the LED driver. By modifying the Equation (2), the following Equation (3) is obtained:

$$I_{H}\sim\Sigma(V_i,I_i,D_i)/_{i=R,G,B}/(V_{DD}\cdot\eta) \tag{3}$$

In Equation (3), $V_i$ and $V_{DD}$ are measured values, $I_i$ is a set value, $D_i$ is a determined value, and η is a known value of about 90%.

Accordingly, $I_{DD}$ can be calculated by Equation (3), and this value is more accurate than the value measured by the supply current measurement unit 510, since the accuracy of Ii is about ±1% and η has a value of about 90 to 92%.

Calculation of Equation (3) may be performed using a software system that transfers the measured $V_{DD}$ and $V_i$ to an external Personal Computer (PC) using a communication protocol such as 12C, and calculates the measured value in the PC, thereby reducing system complexity. By writing a new R, G, and B LED current set value in a chip register after comparing $I_{DD}$ value calculated through the above-described calculation with the target $I_{DD}$ value, the supply current value, i.e., the LED power consumption, can be uniformly maintained with little error.

The configuration of circuit 600 of FIG. 6 for controlling the LED power consumption according to the fourth embodiment of the invention is further described below. The circuit 600 for controlling the LED power consumption according to the fourth embodiment of the invention includes a power calculation unit 61 for calculating the LED power by measuring the supplied voltage and the LED driving voltage, and a current adjustment unit 62 for comparing the power calculated by the power calculation unit 61 with a preset power and adjusting the current flowing to the LED according to the comparison value.

The power calculation unit 61 includes the LED voltage measurement unit 640 for measuring the voltage applied to both ends of the RGB LED and for outputting the measured values RSENS, GSENS, and BSENS, and the supply voltage measurement unit 610 for measuring the supply voltage.

The current adjustment unit 62 includes a dimming unit 630 for comparing the preset current values RSET, GSET, and BSET of the respective light sources with the calculated supply current of the light source externally calculated through the measured value of the power calculation unit 61, adding/subtracting the difference value to maintain the power consumption of the respective light sources uniformly, and time-dividing the output value according to the respective RGB light sources, a switching unit 620 for receiving an output signal of the dimming unit 630, for changing the output voltage to the LED according to the received output signal, and for controlling the output voltage to maintain the total power consumption as the preset power value, and a timing control unit 650 for receiving external REN (RED_ENABLE), GEN (GREEN_ENABLE), and BEN (BLUE_ENABLE) signals and time-sequential controlling transistors to control the timing of the respective LEDs.

The LED power consumption (W) is approximately estimated by calculating the LED supply current using the resultant values calculated through the LED voltage measurement unit 640 and the supply voltage measurement unit 610 utilizing Equation (3), multiplying the calculated supply current by measured supply voltage $V_{DD}$ and then multiplying the multiplied value by the power efficiency (maximally 90%) of the LED driver.

The VIN of in FIG. 6 is a power supply voltage, which may be provided by a portable phone Lithium-ion (Li+) battery. The switching unit 620 is preferably a DC-DC converter, and may use a buck-boost converter. VOUT denotes an output voltage of the switch unit 620, which is changed according to the FB input.

Figure 8:
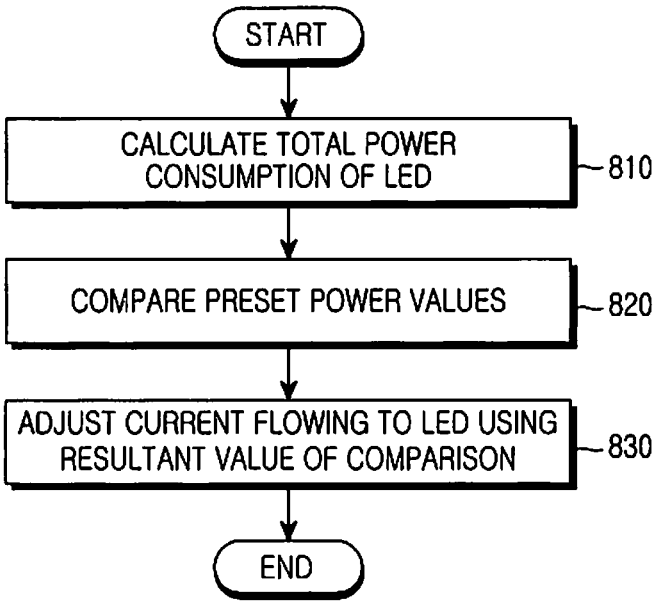
FIG. 8 is a flowchart illustrating a flow of a power control operation of an LED according to an embodiment of the present invention.

Referring to FIG. 8, according to the power control operation of LED according to an embodiment of the present invention, the total power consumption of the LED is calculated in step 810. In this case, power calculation according to the respective embodiments of the invention is used. In step 820, the preset power value and the power calculated in step 810 are compared. In step 830, the current flowing to the LED is adjusted according to the resultant value of the comparison in step 820, to uniformly maintain a desired level through the current flowing to the LED.

According to an embodiment of the invention, instead of the APC system for controlling the optical output of the light source in conventional systems, the thermal runaway of the LED that is the light source of the mobile projector can be prevented by applying the APCC (Automatic Power Consumption Control) to maintain the power consumption of the light source uniformly according to the characteristic of the present invention.

Also, the LED power consumption is set as desired and can be easily adjusted. Accordingly, the trial and error and the complexity that follow in maintaining the whole power consumption in the RGB LED time-sequential driving can be removed.

Also, the control system according to the present invention can be used as a Watt calibration building block when configuring an LED driver Application Specific Integrated Circuit (ASIC).

Also, during the Watt calibration, the complex programming can be simplified, and since the power consumption is adjusted in a state where the RGB current ratio is maintained, the distortion of the white point can be reduced.

A method and an apparatus for controlling the power consumption of a light source in a mobile projector according to an embodiment of the present invention has the construction and operation as described above. While the invention has been shown and described with reference to certain embodiments thereof, various modifications may be made without departing from the scope of the invention, as defined by the following claims.

What is claimed is:

1. A method of controlling power consumption of a light source in a mobile projector, the method comprising the steps of:

calculating power consumption of the light source; and comparing the calculated power consumption of the light source with a preset power value and adjusting current flowing to the light source according to a resultant value of the comparison, wherein calculating power consumption of the light source comprises:

measuring a voltage applied to both terminals of the light source, measuring the current flowing to the light source, and calculating the power consumption of the light source by multiplying the measured voltage and current, and wherein adjusting current flowing to the light source comprises:

calculating a difference value between the preset power value and the calculated power consumption of the light source;

adding/subtracting the calculated difference value to/from a preset current value to output a resultant value; and changing voltage output to the light source according to the output resultant value.

2. The method as claimed in claim 1, wherein the light source is at least one of a Light Emitting Diode (LED) and an Organic Light Emitting Diode (OLED).

3. The method as claimed in claim 2, wherein the light source comprises red, green, and blue LEDs or a pair of OLEDs.

4. A method of controlling power consumption of a light source in a mobile projector, the method comprising the steps of:

calculating power consumption of the light source;

comparing the calculated power consumption of the light source with a preset power value; and adjusting current flowing to the light source according to a resultant value of the comparison, wherein calculating power consumption of the light source comprises:

measuring a voltage applied to both terminals of the light source;

measuring the current flowing to the light source; and calculating a total power consumption of the respective light sources using the measured voltage and current of the respective light sources, and wherein adjusting current flowing to the light source comprises:

calculating a difference between the preset power value and the total power consumption of the light, and calculating time-sequential output values according to respective RGB light sources to adjust respective currents of the RGB light sources by adding/subtracting the calculated difference value to/from preset current values of the respective light sources to output resultant values.

5. The method as claimed in claim 4, wherein adjusting current flowing to the light source further comprises receiving the output resultant values and changing the output voltages to the light sources according to the output resultant values;

wherein the time-sequential values are according to the respective light sources to maintain a ratio of the preset current values of the respective light sources, and voltages output to the light sources are adjusted to maintain the total power consumption as the preset power values.

6. The method as claimed in claim 4, wherein calculating total power consumption includes calculating the total power consumption by summing values obtained by multiplying the voltage, the current, and duty ratios of the respective light sources in time-sequential driving for each light source.

7. A method of controlling power consumption of a light source in a mobile projector, the method comprising the steps of:

calculating power consumption of the light source;

comparing the calculated power consumption of the light source with a preset power value; and adjusting current flowing to the light source according to a resultant value of the comparison, wherein calculating total power consumption of the light source comprises measuring the supply current supplied to the light source and calculating an approximate value of the power consumption of the light source by multiplying the measured value by the input voltage and the power efficiency of a light source driver.

8. The method as claimed in claim 7, wherein adjusting current flowing to the light source comprises:

calculating a difference value between the preset power value and an approximate value of the calculated power consumption of the light source;

adding/subtracting the difference value to/from a preset current value to output a resultant value; and receiving the output resultant value and changing voltage output to the light source according to the output resultant value.

9. An apparatus for controlling power consumption of a light source in a mobile projector, the apparatus comprising:

a power calculation unit for calculating power consumption of the light source; and a current adjustment unit for comparing the power calculated by the power calculation unit with a preset power value and adjusting a current flowing to the light source according to the comparison, wherein the power calculation unit comprises:

a voltage measurement unit for measuring a voltage applied to both terminals of the light source, a current measurement unit for measuring the current flowing to the light source, and a calculation unit for calculating a total power consumption of using the measured voltage and current of respective light sources, and wherein the current adjustment unit comprises:

a comparator for calculating a difference value between the preset power value and the power consumption of the light source;

a dimming unit for adding/subtracting the difference value calculated by the comparator to/from a preset current value to output a resultant value; and a switching unit for receiving an output resultant value of the dimming unit and changing voltage output to the light source according to the output resultant value of the dimming unit.

10. The apparatus as claimed in claim 9, wherein the light source is one of a Light Emitting Diode (LED) and an Organic Light Emitting Diode (OLED).

11. The apparatus as claimed in claim 10, wherein the light source comprises red, green, and blue LEDs or a pair of OLEDs.

12. An apparatus for controlling power consumption of a light source in a mobile projector, the apparatus comprising:

a power calculation unit for calculating power consumption of the light source; and a current adjustment unit for comparing the power calculated by the power calculation unit with a preset power value and adjusting a current flowing to the light source according to the comparison, wherein the power calculation unit comprises:

a voltage measurement unit for measuring a voltage applied to both terminals of the light source;

a current measurement unit for measuring the current flowing to the light source; and a calculation unit for calculating a total power consumption of the respective light sources using the measured voltage and current of the respective light sources, wherein the current adjustment unit comprises:

a comparator for calculating a difference between the preset power value and the total power consumption of the light calculated by the calculation unit;

a dimming unit for time-dividing the output values according to the respective RGB light sources to adjust respective currents of the RGB light sources by adding/subtracting the calculated difference value calculated by the comparator to/from preset current values of the respective light sources to output resultant values, and outputting output values according to the respective light sources to maintain a ratio of the preset current values of the respective light sources.

13. The apparatus as claimed in claim 12, wherein the current adjustment unit further comprises:

a switching unit for receiving an output signal of the dimming unit, changing voltages output to the light sources according to the output signal of the dimming unit, and adjusting the voltages output to maintain the total power consumption as the preset power values.

14. The apparatus as claimed in claim 13, wherein the calculation unit calculates the total power consumption by summing values obtained by multiplying the voltage, the current, and duty ratios of the respective light sources in time-sequential driving for each light source.

15. An apparatus for controlling power consumption of a light source in a mobile projector, the apparatus comprising:

a power calculation unit for calculating power consumption of the light source; and a current adjustment unit for comparing the power calculated by the power calculation unit with a preset power value and adjusting a current flowing to the light source according to the comparison, wherein the calculation unit comprises a supply current measurement unit for measuring the supply current supplied to the light source and calculating an approximate value of the power consumption of the light source by multiplying the measured value by the input voltage and the power efficiency of a light source driver, wherein the current adjustment unit comprises:

a comparator calculating a difference value between the preset power value and an approximate value of the calculated power consumption of the light source calculated by the supply current measurement unit;

a dimming unit for adding/subtracting the difference value calculated by the comparator to/from a preset current value to output a resultant value; and a switching unit for receiving the output resultant value and changing voltage output to the light source according to the output resultant value.

16. The apparatus as claimed in claim 15, wherein the switching unit is a DC-DC converter.

17. The apparatus as claimed in claim 15, wherein the switching unit is a buck-boost converter.

18. An apparatus for controlling power consumption of a light source in a mobile projector, the apparatus comprising:

a power calculation unit for calculating power consumption of the light source by measuring a supply voltage and a driving voltage of the light source; and a current adjustment unit for comparing the power calculated by the power calculation unit with a preset power value and adjusting a current flowing to the light source according to the comparison, wherein the power calculation unit comprises:

a driving voltage measurement unit for measuring a voltage applied to both terminals of the light source; and a supply voltage measurement unit for measuring the supply voltage of the light source;

wherein the current of the light source is calculated using measured values measured by the driving voltage measurement unit and the supply voltage measurement unit, and wherein the current adjustment unit comprises:

a dimming unit for comparing a preset current value of the light source and the calculated power of the light source, adding/subtracting a calculated difference value to maintain the preset power value of the light source, and time-dividing output values to the light source; and a switching unit for receiving an output signal of the dimming unit, changing the output voltages to the light source according to the time-divided output of the dimming unit, and adjusting output voltages to maintain a total power consumption as the preset power value.

19. The apparatus as claimed in claim 18, wherein the light source is one of a red LED, green LED, and a blue LED, or a pair of OLEDs.

20. A method of controlling power of a light source in a mobile projector, the method comprising the steps of:

calculating power consumption of the light source by measuring a supply voltage and a driving voltage of the light source; and comparing the calculated power consumption with a preset power value and adjusting a current flowing to the light source according to the comparison, wherein calculating power consumption of the light source by measuring the supply voltage and the driving voltage comprises measuring a voltage applied to both terminals of the light source, measuring the supply voltage of the light source, and calculating the current of the light source using measured values, and wherein comparing the calculated power consumption with the preset power value comprises:

comparing a preset current value of the light source and the calculated supply current of the light source, adding/subtracting a calculated difference value to maintain the preset power value of the light source, and time-dividing output values to the light source; and changing the output voltages to the light source according to the time-divided output signal, and adjusting output voltages to maintain a total power consumption as the preset power value.

21. The method as claimed in claim 20, wherein the light source is one of a red LED, a green LED, and a blue LED, or a pair of OLEDs.

* * * * *